US005918383A

United States Patent [19]

Chee

[11] Patent Number: 5,918,383

[45] **Date of Patent: *Jul. 6, 1999**

[54] SPORTS SHOE HAVING AN ELASTIC INSERT

[75] Inventor: Wong King Chee, Kowloon, The Hong Kong Special Administrative Region of the People's Republic of China

[73] Assignee: Fila U.S.A., Inc., Sparks, Md.

[ * ] Notice: This patent is subject to a terminal disclaimer.

[21] Appl. No.: 08/543,443

[22] Filed: Oct. 16, 1995

[51] Int. Cl.[6] ..... A43B 13/18; A43B 19/00; A43B 21/26

[52] U.S. Cl. ..... 36/28; 36/71; 36/35 B

[58] Field of Search ..... 36/28, 29, 71, 36/25 R, 35 B, 35 R

[56] References Cited

U.S. PATENT DOCUMENTS

| | | |
|---|---|---|
| 74,912 | 2/1868 | Hadley . |
| 456,677 | 7/1891 | McIntyre . |
| 532,429 | 1/1895 | Rodgers . |
| 536,590 | 3/1895 | Tillgren . |
| 1,559,532 | 10/1925 | Smith . |
| 1,598,809 | 9/1926 | Dressel . |
| 1,605,408 | 11/1926 | Huiskamp . |
| 1,605,588 | 11/1926 | Huiskamp . |
| 1,981,300 | 11/1934 | Berg . |
| 2,146,888 | 2/1939 | Fisch . |
| 2,721,400 | 10/1955 | Israel . |
| 3,253,355 | 5/1966 | Menken . |
| 4,012,854 | 3/1977 | Berend et al. . |
| 4,187,620 | 2/1980 | Selner . |
| 4,219,945 | 9/1980 | Rudy . |
| 4,236,326 | 12/1980 | Inohara . |
| 4,262,433 | 4/1981 | Hagg et al. . |
| 4,297,797 | 11/1981 | Meyers . |
| 4,319,412 | 3/1982 | Muller et al. . |
| 4,358,902 | 11/1982 | Cole et al. . |
| 4,364,186 | 12/1982 | Fukuoka . |
| 4,391,048 | 7/1983 | Lutz . |
| 4,397,104 | 8/1983 | Doak . |
| 4,417,407 | 11/1983 | Fukuoka . |
| 4,446,634 | 5/1984 | Johnson et al. . |
| 4,462,171 | 7/1984 | Whispell . |
| 4,472,890 | 9/1984 | Gilbert . |
| 4,535,553 | 8/1985 | Derdereian et al. . |
| 4,546,555 | 10/1985 | Spademan . |
| 4,608,768 | 9/1986 | Cavanagh . |
| 4,610,099 | 9/1986 | Signori . |
| 4,616,431 | 10/1986 | Dassler . |
| 4,631,843 | 12/1986 | Annovi . |

(List continued on next page.)

FOREIGN PATENT DOCUMENTS

| | | |
|---|---|---|
| 77203615 | 4/1988 | China . |
| 77206424 | 7/1988 | China . |
| 0 215 995 | 4/1987 | European Pat. Off. . |
| 33 38 557 | 5/1985 | Germany . |
| 601 627 | 5/1948 | United Kingdom . |
| 2 183 446 | 6/1987 | United Kingdom . |

*Primary Examiner*—B. Dayoan
*Attorney, Agent, or Firm*—Oblon, Spivak, McClelland, Maier & Neustadt, P.C.

[57] ABSTRACT

A sports shoe insert is provided which includes a plurality of elastically deformable elements which extend vertically within a heel portion of a shoe wherein the deformable elements are shaped such that a substantially horizontal plane cross-section taken through each of the deformable elements is of a polygonal shape and a plurality of arm members respectively interconnect the deformable elements. The maximum cross-sectional area of the deformable elements is located in a central region thereof and at least the top portion of the deformable elements as a group form a concave seat for contact a heel portion of the person wearing the shoe. The arm members lie in a single substantially horizontal plane and interconnect the central portion of each of the deformable elements. The arm members and deformable elements form a plurality of interconnected triangular-shaped groupings as viewed from above. In addition, both the top portion and bottom portion of the deformable elements as a group may form a concave seat. A method of forming the insert is also provided.

19 Claims, 5 Drawing Sheets

U.S. PATENT DOCUMENTS

| | | | |
|---|---|---|---|
| 4,674,206 | 6/1987 | Lyden . | |
| 4,768,295 | 9/1988 | Ito . | |
| 4,783,910 | 11/1988 | Boys, II et al. . | |
| 4,794,707 | 1/1989 | Franklin et al. . | |
| 4,815,221 | 3/1989 | Diaz . | |
| 4,817,304 | 4/1989 | Parker et al. . | |
| 4,843,741 | 7/1989 | Yung-Mao . | |
| 4,845,863 | 7/1989 | Yung-Mao . | |
| 4,874,640 | 10/1989 | Donzis . | |
| 4,887,367 | 12/1989 | Mackness et al. . | |
| 4,908,962 | 3/1990 | Yung-Mao . | |
| 4,912,861 | 4/1990 | Huang . | |
| 4,918,838 | 4/1990 | Chang . | |
| 4,924,605 | 5/1990 | Spademan . | |
| 4,934,072 | 6/1990 | Fredericksen et al. . | |
| 4,936,029 | 6/1990 | Rudy . | |
| 4,956,927 | 9/1990 | Misevich et al. . | |
| 4,970,807 | 11/1990 | Anderie et al. . | |
| 4,993,173 | 2/1991 | Gardiner . | |
| 4,995,173 | 2/1991 | Spier . | |
| 4,999,932 | 3/1991 | Grim . | |
| 5,010,661 | 4/1991 | Chu . | |
| 5,010,662 | 4/1991 | Dabuzhsky et al. . | |
| 5,025,575 | 6/1991 | Lakic . | |
| 5,042,176 | 8/1991 | Rudy . | |
| 5,067,256 | 11/1991 | Darby . | |
| 5,068,981 | 12/1991 | Jung . | |
| 5,074,765 | 12/1991 | Pekar . | |
| 5,086,574 | 2/1992 | Bacchiocchi . | |
| 5,092,060 | 3/1992 | Frachey et al. | 36/29 |
| 5,113,599 | 5/1992 | Cohen et al. . | |
| 5,158,767 | 10/1992 | Cohen et al. . | |
| 5,174,049 | 12/1992 | Flemming . | |
| 5,224,278 | 7/1993 | Jeon . | |
| 5,233,767 | 8/1993 | Kramer . | |
| 5,253,435 | 10/1993 | Auger et al. . | |
| 5,369,896 | 12/1994 | Frachey et al. | 36/29 |
| 5,384,977 | 1/1995 | Chee | 36/28 |

SPORTS SHOE HAVING AN ELASTIC INSERT

BACKGROUND OF THE INVENTION

Field of the Invention

The present invention relates to a sports shoe having an insert at least in the heel region of the shoe, the insert including an airtight flexible casing enclosing a series of interconnected elastically deformable bodies.

Discussion of the Background

Athletic foot wear is required to provide a stable support region while being simultaneously comfortable for the user. This solves the problem of allowing for comfort while providing stable support and also achieving a counter thrusting effect, i.e., partially recovery of the thrust as the footwear separates from the ground plus absorption of the impact against the ground. In response to this need, solutions of the type described in the following paragraph have been proposed.

Known prior inserts positioned in the footwear heel have acted primarily as a complex spring so that, after the impact of the footwear against the ground and the simultaneous damping effect, there is partial restitution of the energy absorbed by the insert on impact. While all the known inserts offer comfort, stability and adequate damping and energy recovery through a certain range of loading an impact velocity, they can prove partially unsatisfactory outside predetermined parameters. As an example, footwear provided with an insert can satisfy the requirements of slow movement but not of fast movement, whereas an insert designed for fast movement could prove too rigid for slow movement. In addition to this, for equal footwear sizes, the weight of the wearer can vary within extremely wide limits, so that the same insert can prove either rigid or excessively yielding.

Also known are the inserts shown in U.S. Pat. Nos. 5,369,896; 5,092,060 and 5,384,977, the disclosures of which are incorporated herein by reference.

SUMMARY OF THE INVENTION

An object of the present invention is to provide an insert having an airtight-casing wherein a plurality of elastically deformable elements are located. The casing has a top surface and bottom surface, both in contact with the upper and lower ends of the deformable elements, the latter being very strongly soldered, bonded or adhered to such surfaces so as to remain fixed to them during use of the shoe. At least a majority of the elements are each tapered toward opposing free ends thereof and have a major cross-section in a central region thereof. To each of the elements is fixed arms, the arms joining adjacent elements so that the combination of three elements are positioned so as to form a triangle, as viewed from the top or bottom of the casing.

A further object of the present invention is to provide deformable elements having different heights extending from the perimeter edge of the casing to a central zone of the casing. In particular, it is desired that the shape of the elements allow at least the casing top surface to be concave so as to create a type of seat for the user's heel. However, thanks to such different heights, both the top and bottom surfaces of the combined deformable elements can form a concave surface region so as to allow easier mounting of the insert into the sole and also permit improved stability for the user during use of the sports shoe.

Due to such different heights which increase from the central zone to the periphery of the insert, the rigidity of the insert correspondingly increases and thus is beneficial to the stability of the user during use of the sports shoe.

A further object of the present invention is to shape at least a majority of the elements such that substantially all horizontal plane cross-sections of each of the elements taken along a longitudinal axis of the shoe form a polygonal figure. The elements are also provided in the casing so as to form a plurality of coaxial rows, however, these inserts can be instead located so as to form polygonal rows.

The present invention provides greater stability for the user's foot during use of the shoe due to the particular shape of the deformable elements, the shape thus enabling the foot to be kept in a substantially fixed position inside the shoe.

The invention also provides better elastic return to the user's foot during the use of the shoe due, in particular to the triangular grouping or connection of the deformable elements, the deformable elements providing good response to stresses which are perpendicular to the ground over which the user moves or which are parallel to the ground (which movement is generated, for example, during sliding action of the user).

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
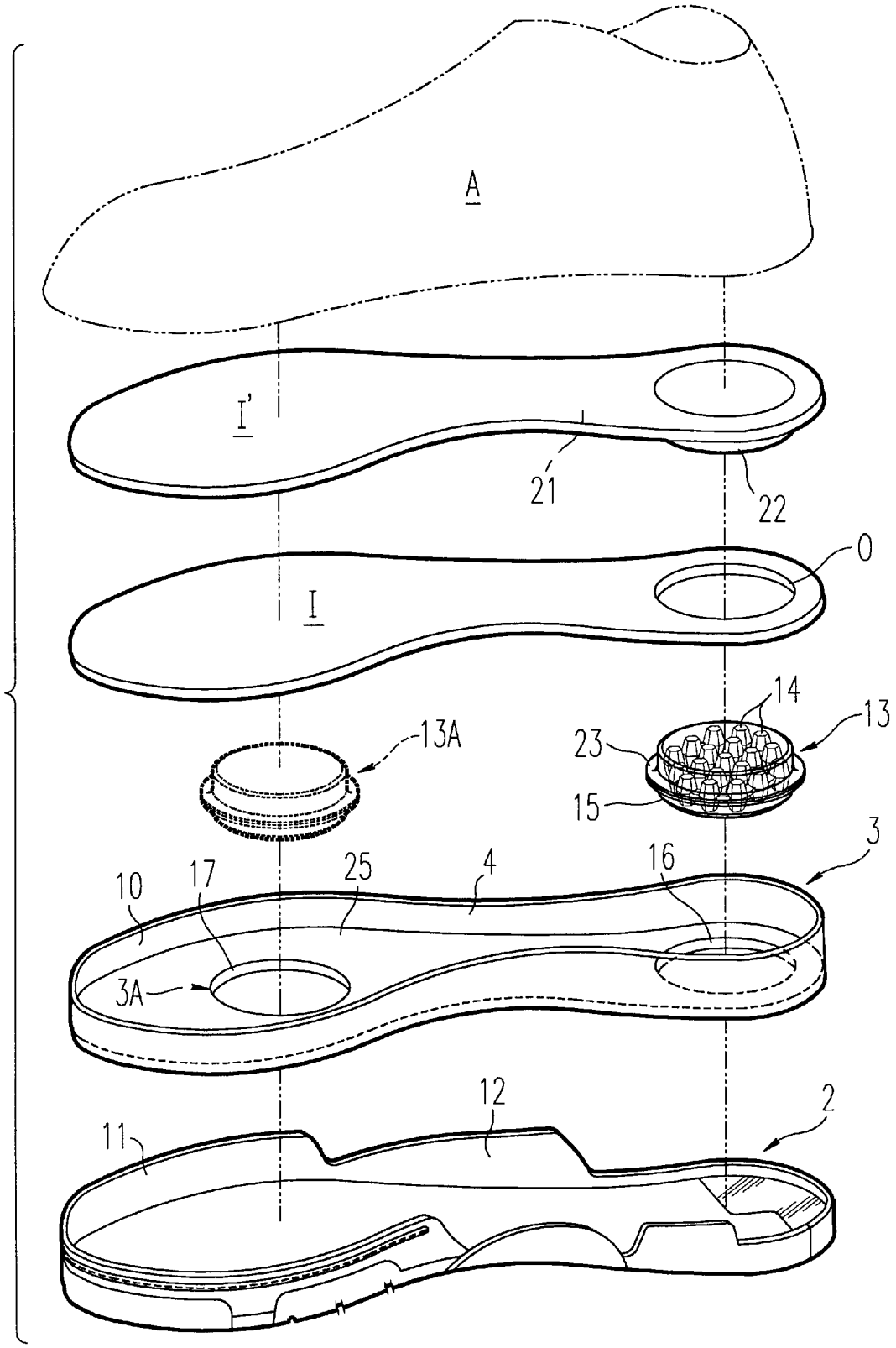
FIG. 1 is an exploded view of the lower support part of a sports shoe according to the present invention.

Referring to the figures, the sports shoe of the present invention includes a vamp A and a lower support part 1 which includes a sole 2, for example, made of synthetic rubber to which a wedge 3, which is, for example, made of thermoplastic polyurethane, is fixed in a known manner. The wedge includes a recess 4, bounded by a raised edge 10, carrying a mounting insole I, for example made of cork, having an opening O formed therein and on which there is a positioned a further insole I', for example made of fabric (not shown in FIG. 3). The sole 2 is preferably made of rubber and includes notches 7 and recessed portions 8 in its lower surface. It also includes a raised front edge 11 and a lateral edge 12 which extends along the entire remaining perimeter of the sole.

While a sports shoe is referred to above, it is understood that any type of shoe using the insert of the present invention is within the scope of the invention claimed and is within the meaning of the terms "sports shoe" or "footwear". In accordance with the present invention, in the lower part of the shoe there is positioned an insert 13 comprising elastically deformable elements 14 made of a thermoplastic material and enclosed in an airtight casing 15 made of a plastic material such as polyurethane or a similar material. Within casing 15 there is present air that has a pressure less than or equal to atmospheric pressure. In the examples shown, the insert 13 is positioned in seats 16, 17 provided in the wedge 3 and in the insole 5 respectively, the seats being spaced apart as shown in FIG. 1. Alternatively, seat 17 can be omitted with insert 13 only being located in seat 16 of wedge 3, so that the insole I is superimposed and covers seat 16. The elements 14 of the insert 13 are formed by molding any desirable synthetic high-elastic material and are substantially polygon-shaped when viewed in vertical cross-section, i.e., they are tapered at their opposed free ends 5 and 6 and have the major cross-sections thereof located substantially in a central region 20 in which the elements are joined together by arm members forming an integral bridging portion 20A. As can be appreciated from a review of FIG. 3, at least a majority of the elements 14 are polygonal shaped in the sense that all vertical cross-sections taken along the vertical or horizontal axis thereof are in the shape of a polygon. Due to the manufacturing requirements of the insert 13, the free ends 5, 6 of the elements 14 are connected to casing 15. This is actually the preferred embodiment of insert 13, wherein in a first phase, the elements 14 are obtained by means of molding and subsequently are encased inside thermo-soldering plastic sheets which constitute casing 15. The elements 14 are encased by the sheets when they are at a relatively high temperature so that welding or bonding of the free ends 5, 6 of the elements with the sheets occurs. The connection between casing 15 and the elements 14 has the advantage of anchoring the elements inside the casing thereby preventing the casing and the elements from moving during use of the shoe according to the invention and thus contributing together with the mutual connection of the elements 14 to good multidirectional stability and flexibility of the resulting shoe. This also affords greater stability for the insert within the shoe and permits better performance in terms of the function for which it is intended, said function being described further hereinbelow.

The shape of the elements 14 as shown and described by way of example, allows considerable absorption of the stresses caused by the user's foot upon movement, and at the same time allows a large part of the absorbed energy to be retransmitted rapidly to the foot. Each element 14 may be shaped as illustrated, e.g. polygon shaped or else shaped so as to be circular shaped when viewed in the direction of the horizontal cross-section thereof.

In order to secure insert 13 within the seats 16, 17, the insole I' comprises on the face 21, facing the insole I, a projection 22 of a shape corresponding to the seat 16 and arranged to cooperate with it and with the insert 13. In the alternative embodiment noted above, the projection 22 can, however, be omitted.

The casing 15 of insert 13 includes a flange 23 located at a midportion of the side of the casing which, when the insert 13 has been positioned in the lower part of the shoe, rests on a step 24 provided between the insole I and the inner surface 25 of the wedge 3. In the alternative, where the hole or seat 17 is omitted, the flange 23 which is very thin rests on the wedge seat 16.

During use of the sole and in accordance with the present invention, each time the user presses the lower part of the shoe with his foot, the insert 13 is pressed toward the sole. Specifically, the pressing action exerted by the foot depresses the elements 14 which deform and increase the pressure within the airtight casing 15 which is constricted by the surrounding wall portion of its seat. When the user's heel ceases the pressing action, the elements 14 return to their initial configuration, so as to transmit a large part of the energy acquired during the pressing action to the user's foot, which therefore receives a gradual thrust as the heal of the user (or other part of the foot, e.g., the metatarsal) separates from the ground. To said thrust, exerted on the user's foot by elements 14 there must be added the thrust exerted by the air inside casing 15, this air being under pressure due to the action of the user's foot. These combined thrusts help transfer to the user's foot part of the energy transmitted by the user to the ground during movement.

Elastic inserts like the one described above can be located in other regions of the support part 1, in particular in proximity with the frontal region of a sole 2 and wedge 3 and, more specifically, in the metatarsal zone 3A as shown in dotted lines in FIG. 1, where the seat is referenced by number 17 and insert 13A is utilized, thus allowing the user, in particular an athlete, to obtain increased pick-up during acceleration or during changes in the rate of movement.

Figure 4:
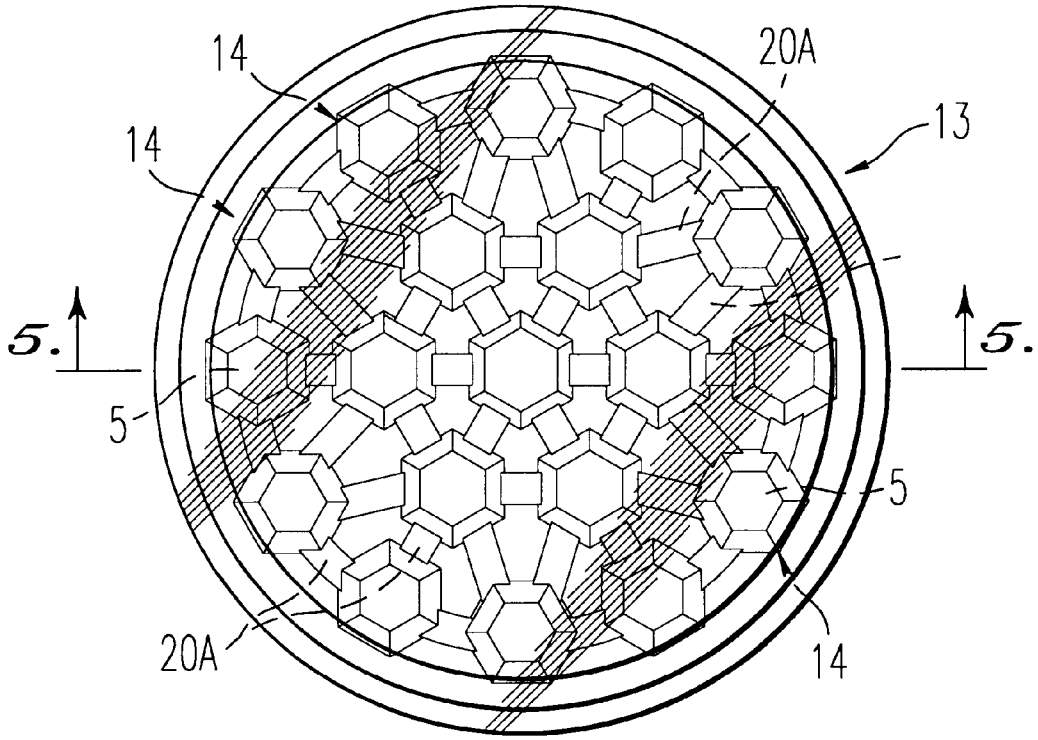
FIG. 4 is a top view of the casing and the deformable elements.
Figure 5:
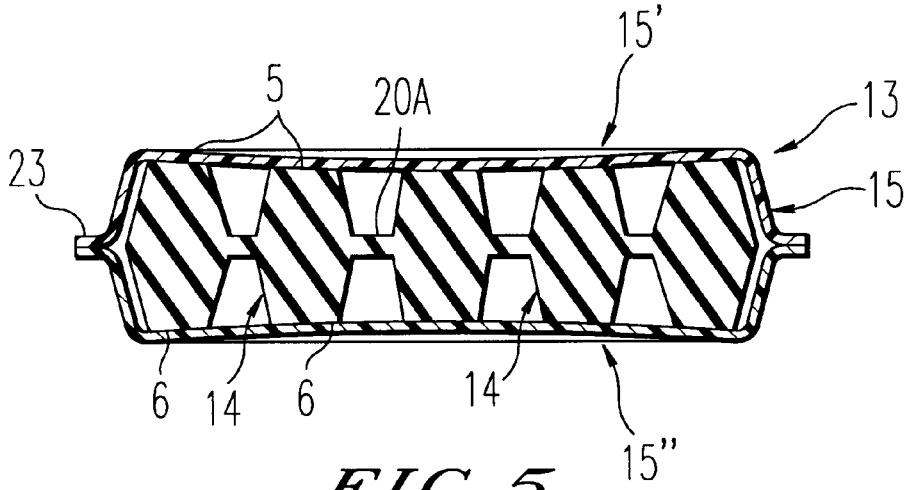
FIG. 5 is a view taken along line 5—5 of FIG. 4.

With reference to FIG. 4 and 5, the casing 15 has a top surface 15' and a bottom surface 15", both in contact with the upper and lower surface elements, 5, 6, the latter being very strongly soldered or connected to such surfaces so as to remain fixed to them during use of the shoe. Each element 14 is tapered towards opposing free ends, 5, 6 and has a major cross-section in the central region thereof. These elements are therefore each substantially diamondshaped in vertical cross-section as shown in these figures. To the latter are fixed the arms 20A, the arms joining each element 14 to the adjacent elements 14, 14. More specifically, three adjacent elements are respectively located at each vertex of a triangle as viewed from the top or bottom of the casing 15.

Elements 14 have varying heights from the perimeter of the casing in a direction towards a central zone of the casing so that the rigidity of the insert increases from the center to the periphery of the insert. In particular, the shape of the elements allows at least the casing top surface 15' to be concave so as to create a seat for the user's heel. However, due to the different heights, one or both the top and bottom surfaces of the combined elements are concave so as to allow easier mounting of the insert into the sole. This also permits improved stability for the user during use of the support shoe. Moreover, each element 14 is preferably shaped so that substantially all horizontal plane cross-sections thereof taken along the longitudinal axis of the shoe are polygonal figures. In the preferred embodiment shown, the elements 14 are located in the casing in a plurality of coaxial rows. However, these elements can be located so as to form a plurality of polygonal rows.

The advantages provided by the present invention are as follows. Greater stability for the user's foot is provided during the use of the shoe due to the particular differing heights and shapes of the deformable elements. The shape enables the foot to be kept in a substantially fixed position inside the shoe. In addition, better elastic energy return to the user's foot during use of the shoe is provided. Due to the particular "triangular" connection of the elements 14, the elastically deformable elements have a desirable response to stresses which are perpendicular to the ground over which the user moves or which are parallel to the ground (which may be generated, for example, during sliding of the user over the ground).

Figure 6:
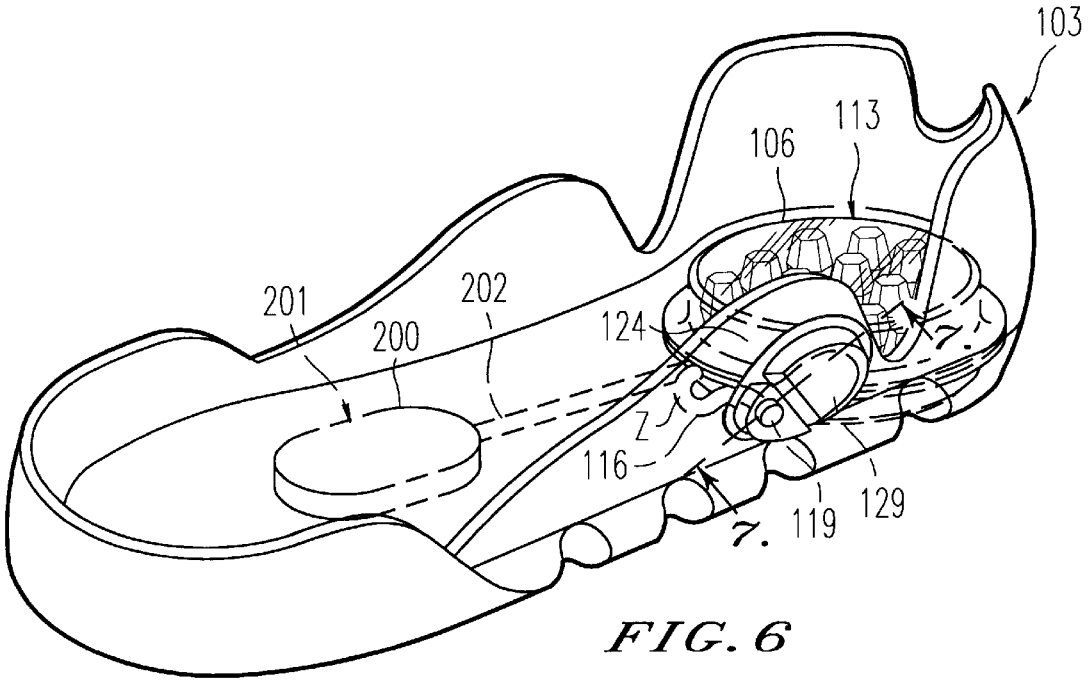
FIG. 6 is a perspective view of the present invention as appears in a second embodiment of the present invention.
Figure 7:
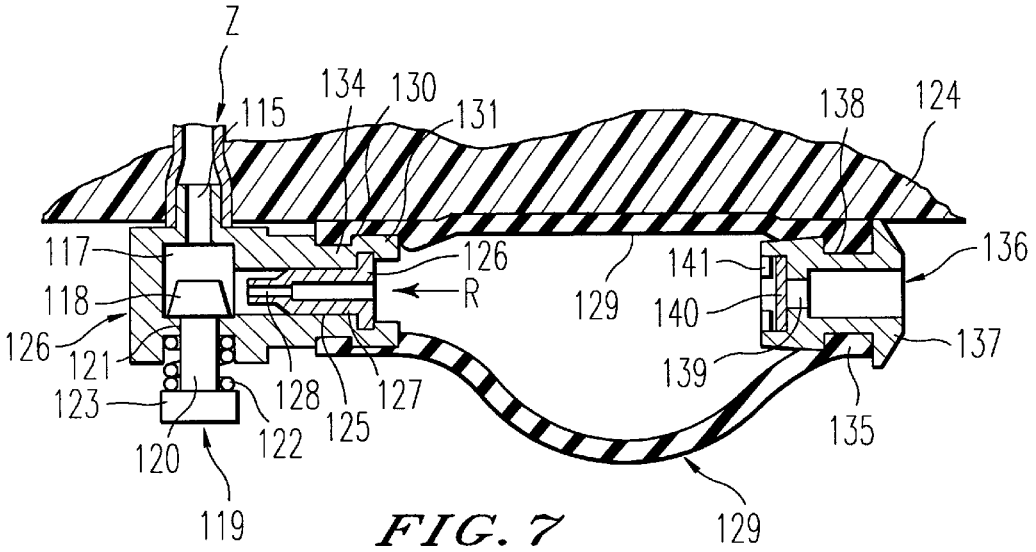
FIG. 7 is a partial sectional view taken along line 7—7 of FIG. 6.
Figure 8:
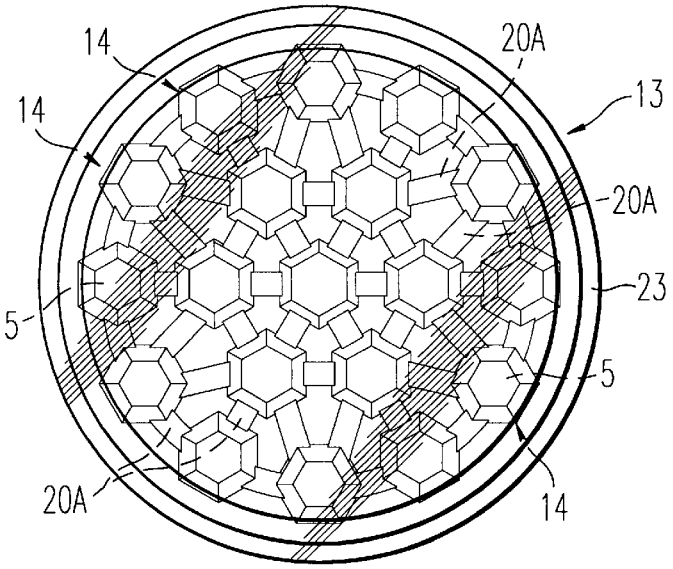
FIG. 8 is a bottom view of the insert.
Figure 9:
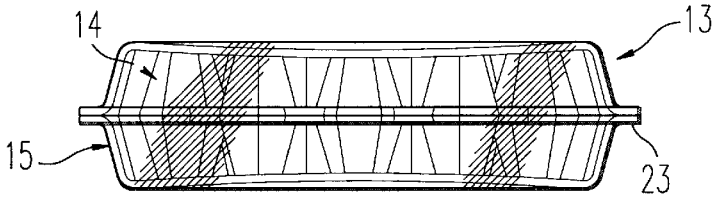
FIG. 9 is a front elevational view of the insert, the rear view being a mirror image of the view shown.
Figure 10:
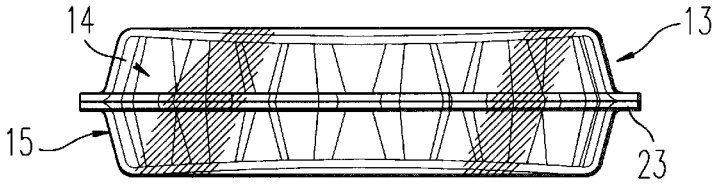
FIG. 10 is a right side elevational view of the insert, the left side view being a mirror image of the side shown.
Figure 11:
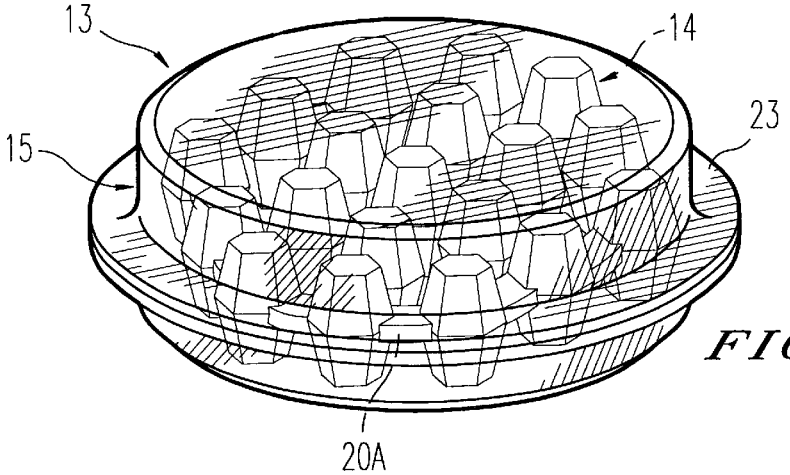
FIG. 11 is a top, front and left side perspective view of the insert.

In FIGS. 6 and 7 showing a second embodiment of the present invention which utilizes the structure described hereinabove with regard to the casing and elastomeric elements 14, in the sole at a position corresponding with the user's heel, there is provided a compartment containing an insert as described above and formed from an elastically deformable cellular structure of thermoplastics material enclosed in an airtight casing 106 of relatively thin flexible plastic material such as polyurethane or the like. Specifically, although non-limitatively shown, the deformable elements 114 are similar to elements 14 described in FIGS. 1–5. The elements 114 are connected to the casing as described in FIGS. 1–5. The casing 106 is formed from two parts welded or connected together and prepared, for example, by vacuum-forming.

Before fixing the parts of the casing 106 together, the elastic deformable members 114 are placed on one of these parts. The other part of the casing 106 is then placed thereon and the parts are joined together by welding along the superposed regions to enclose the elements 114. A duct or tube Z is formed communicating with the interior of the casing as located as shown in FIG. 6.

Figure 2:
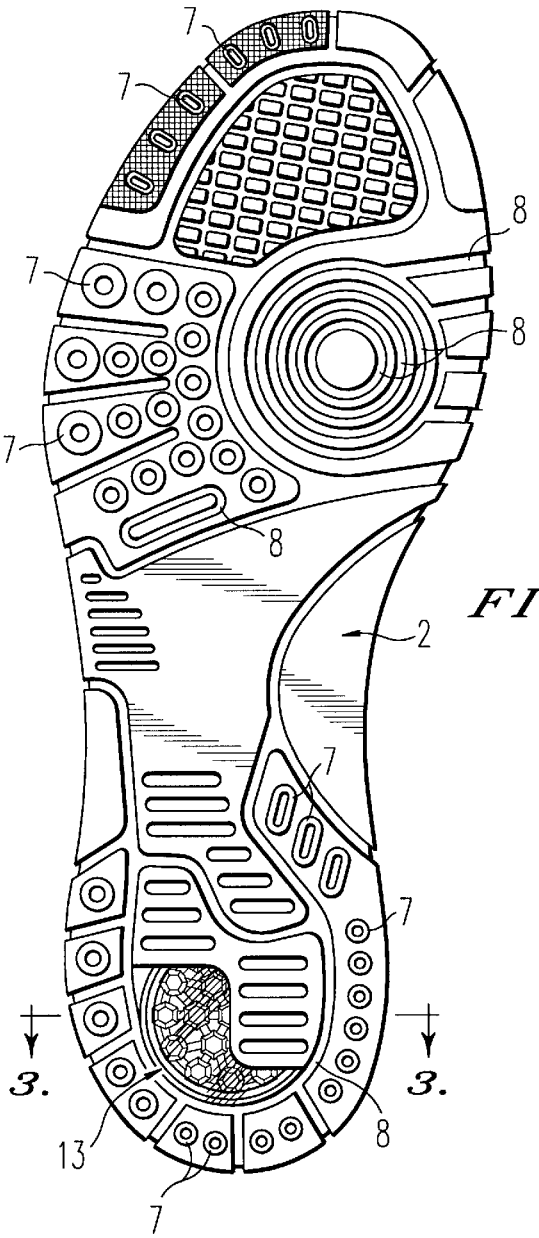
FIG. 2 is a bottom view of the sports shoe according to the invention.
Figure 3:
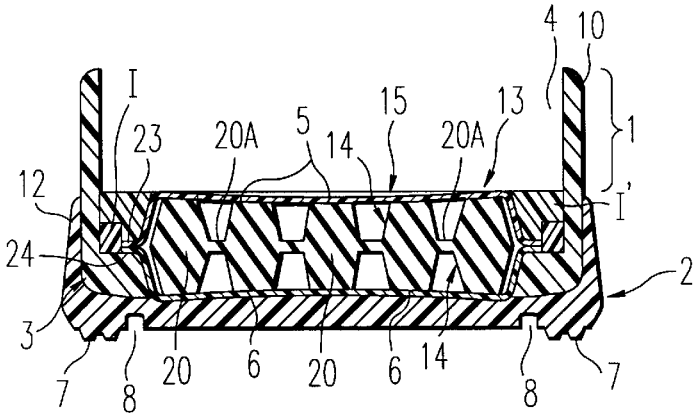
FIG. 3 is a sectional view taken along line 3—3 of FIG. 2.

A seat and a channel 116 are provided in the sole 103. The seat is provided in the heel like as shown in FIGS. 1–3 and contains an insert 113 of a corresponding shape, whereas the tube Z is positioned in channel 116, which directs it to an outer lateral appendix 124 on the sole, where it terminates in an aperture in which it is fixed by a tubular appendix 115 of a plastic block 126 welded to the outside of the appendix 124 and including a chamber 117 in which the valve 118 of a bleed valve 119 is slidingly mounted. The valve member 118 is frusto-conically shaped and is mounted at the end of a stem 120 of a smaller cross-section. The stem passes loosely through a hole 121 and has a head 123. A compression spring 122 positioned between the block 126 and head 123 prevents the chamber 117 and hence the interior of the insert from being connected to atmosphere, whereas if the head 123 is pressed to thus withdraw the valving member 118 from the hole 121, the interior of the insert becomes connected to atmosphere via the space between the stem 120 and the hole 121 which guides it.

The block 126 comprises a hollow lateral appendix 134 in which there is inserted a multidirectional valve 125 of elastic material comprising a seal flange 126, a tubular part 127 and two flat lips 128, which diverge so as to allow air to pass in the direction of the arrow R when pressure is applied to a bellows 129 of elastic material which by means of a lateral hollow appendix 130 is sealedly connected to the appendix 134. For this purpose, the appendix 130 comprises an inner flange 131 which seats in a corresponding annular groove in the appendix 134 of the block 126. The bellows has a flat wall 129 by which it is fixed (welded) to the outer lateral appendix 124 of the sole.

The bellows 129 comprises a second tubular appendix 135, opposite the preceding, in which there is mounted an intake valve 136 comprising a tubular member 137 with a groove 138 into which an inner flange of the appendix 135 elastically clamps. The tubular member 137 comprises a narrow passage 139 which can be intercepted by a plastic disc 140 which moves between this passage and a series of radially arranged spaced-apart teeth 141 which prevent the disc 140 from becoming dislodged from tubular member 137.

When the person wearing the sports footwear wishes to stiffen the insert 113, the bellows 129 is repeatedly pressed. During this pressing action, the air contained in the bellows is transferred into the insert 113 so as to stiffen it, via the delivery valve 129 (the intake value 126 obviously being closed). When the user releases the bellows, this returns to its initial position by virtue of its elasticity, so as to draw air into its interior via the intake valve 136 (the delivery valve remaining closed). On achieving the required rigidity the user ceases the pumping action. If the user wishes to reduce the rigidity, the user discharges pressure from the insert by pressing the head 123 of the bleed valve 119 so as to connect the insert 113 to atmosphere.

As can be seen in FIG. 6, the footwear can also comprise a second insert 200 and positioned in a seat 201 provided in the front part of the sole 103. A tube 202 similar to tube Z pneumatically connects the insert tube 200 to the tube Z, thus allowing the rigidity of the second insert to be simultaneously modified.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. Sports footwear which comprises:

a shoe having at least one insert positioned at least in a heel region of the shoe, said insert comprising an air-impermeable casing of flexible material;

a pump mechanism;

a tube mounted at least partially in the sole for communicating said pump mechanism with said casing for varying air pressure within said casing, so as to modifying the elastic characteristics of the insert, said pump mechanism including an intake valve, a delivery valve for increasing said pressure through said tube, and a bleed mechanism for decreasing said pressure by passing air from said casing through said tube;

said pump mechanism having a bellows located on an exterior portion of the shoe and having a first and second opening, said intake valve being positioned in said first opening and said delivery valve being positioned in said second opening;

a plurality of elastically deformable elements located in the casing which extend vertically in one of a heel portion and a metatarsal portion of the shoe wherein said deformable elements are shaped such that a substantially horizontal plane cross-section taken through each of said deformable elements are of a polygonal shape; and a plurality of arm members respectively interconnecting said deformable elements.

2. Sports footwear as claimed in claim 1, wherein said delivery valve includes a block member located outside said bellows and having a chamber connected to said bellows, said bleed mechanism is connected to said chamber of said block downstream of said delivery valve; said air-permeable casing includes at least two parts, each part comprising an integral appendix and wherein the appendix of each part forms a tube for passage of air to and from the insert.

3. Sports footwear as claimed in claim 1, wherein a maximum cross-sectional area of the deformable elements is located in a central region thereof.

4. Sports footwear as claimed in claim 1, wherein at least a top portion of said deformable elements as a group forms a concave seat for contacting a heel portion of a person wearing the shoe.

5. Sports footwear as claimed in claim 1, wherein said arm members lie in a single substantially horizontal plane and interconnect a central portion of each of the deformable elements.

6. Sports footwear as claimed in claim 1, wherein said arm members and deformable elements form a plurality of interconnected triangular shaped groupings as viewed in said horizontal plane.

7. Sports footwear as claimed in claim 4, wherein the at least top portion comprises said top portion and a bottom portion of said deformable elements and wherein the deformable elements of each of said top and bottom portions as a group form a concave seat.

8. Sports footwear as claimed in claim 1, wherein the pump and the bleed mechanism are both positioned outside the shoe and are rigidly connected therewith.

9. Sports footwear as claimed in claim 8, which comprises an elastically deformable cover connected to the shoe wherein pump and the bleed mechanism are contained within said elastically deformable cover.

10. Sports footwear as claimed in claim 1, wherein said bleed mechanism comprises a pusher-type valve.

11. A method of assembling an insert for a shoe, which comprises:

forming a plurality of polygon shaped deformable members so as to have at least a top portion which forms a concave seat suitable for contacting a heel of a wearer of the shoe and interconnecting said members with a plurality of arm members said members forming a plurality of triangular shaped groupings as viewed in a horizontal plane;

placing the plurality of deformable members into a casing and connecting free end portions of the deformable members to the casing; and placing said casing into at least a heel portion of the shoe.

12. A method as claimed in claim 11, which comprises connecting the casing to an air pressure source connected to the shoe and controlling air pressure in the casing.

13. Sports footwear which comprises:

a shoe having at least one insert positioned at least in one of a heel region and a metatarsal region of the shoe, said insert comprising an air-impermeable casing of flexible material;

a pump mechanism;

a tube mounted at least partially in the sole, said tube communicating said pump mechanism with said casing and varying air pressure within said casing so as to modify the elastic characteristics of the insert, said pump mechanism including an intake valve, a delivery valve increasing said pressure through said tube, and a bleed mechanism decreasing said pressure by passing air from said casing through said tube;

said pump mechanism having a bellows located on an exterior portion of the shoe and having a first and second opening, said intake valve being positioned in said first opening and said delivery valve being positioned in said second opening;

a plurality of elastically deformable elements located in the casing which extend vertically in said one of said heel portion and said metatarsal portion of the shoe wherein at least a top surface portion of said elastically deformable elements form a concave seat for contacting a lower portion of the foot of the user.

14. Sports footwear as claimed in claim 13, wherein said delivery valve includes a block member located outside said bellows and includes a chamber connected to said bellows, said bleed mechanism is connected to said chamber of said block downstream of said delivery valve; said air-impermeable casing includes at least two parts, each part comprising an integral appendix and wherein the appendix of each part forms a tube for passage of air to and from the insert.

15. Sports footwear as claimed in claim 13, wherein a maximum cross-sectional area of the deformable elements is located in a central region thereof.

16. Sports footwear as claimed in claim 13, wherein at least a top portion of said deformable elements as a group forms a concave seat for contacting a heel portion of a person wearing the shoe.

17. Sports footwear as claimed in claim 13, wherein said arm members lie in a single substantially horizontal plane and interconnect a central portion of each of the deformable elements.

18. Sports footwear as claimed in claim 13, wherein said arm members and deformable elements form a plurality of interconnected triangular shaped groupings as viewed in said horizontal plane.

19. Sports footwear including in at least the heel portion thereof an insert comprising an air-impermeable elastically deformable casing, a plurality of elastically deformable, interconnected polygon shaped elements located within and made integral with said casing, said elements being connected by arm members so as to form a plurality of interconnected triangular shaped groupings as viewed in a horizontal plane, the height of said elements increasing towards the periphery of the insert so as to form a concave seat for contacting a heel of a wearer of the shoe.

* * * * *

UNITED STATES PATENT AND TRADEMARK OFFICE

CERTIFICATE OF CORRECTION

PATENT NO. : 5,918,383
DATED : July 6, 1999
INVENTOR(S) : K. Chee Wong

It is certified that error appears in the above-identified patent and that said Letters Patent is hereby corrected as shown below:

Title page,
Item [19], should be -- Wong --.
Item [75], the inventor's name should be:
-- K. Chee Wong --.

Signed and Sealed this

Twenty-first Day of January, 2003

JAMES E. ROGAN
*Director of the United States Patent and Trademark Office*